United States Patent [19]

Jagemann

[11] 4,226,065

[45] Oct. 7, 1980

[54] STAIR CONSTRUCTION AND METHOD FOR MAKING SAME

[76] Inventor: Alfred Jagemann, Warteweg 11, 3401 Seulingen, Fed. Rep. of Germany

[21] Appl. No.: 24,729

[22] Filed: Mar. 28, 1979

[30] Foreign Application Priority Data

Mar. 31, 1978 [DE] Fed. Rep. of Germany ... 7809575[U]
Oct. 20, 1978 [DE] Fed. Rep. of Germany ..... 2845699

[51] Int. Cl.[2] ..... E04F 11/10; E04C 2/26
[52] U.S. Cl. ..... 52/189; 52/309.16
[58] Field of Search ..... 52/309.13–309.17, 52/188–190

[56] References Cited

U.S. PATENT DOCUMENTS

| | | | |
|---|---|---|---|
| 707,635 | 8/1902 | Poulson | 52/189 |
| 2,577,864 | 12/1951 | Thornton et al. | 52/190 |
| 3,415,708 | 12/1968 | Rondum | 52/309.14 X |
| 3,546,832 | 12/1970 | Smith | 52/309.16 |
| 4,132,043 | 1/1979 | Juba | 52/309.17 |

FOREIGN PATENT DOCUMENTS

| | | | |
|---|---|---|---|
| 743362 | 5/1970 | Belgium | 52/309.14 |
| 647401 | 10/1962 | Italy | 52/188 |

*Primary Examiner*—J. Karl Bell
*Attorney, Agent, or Firm*—Miller & Prestia

[57] ABSTRACT

Stair construction and process for producing same are provided wherein at least one wooden plate is provided to form a wooden shell which constitutes the stair outer surface. A reinforcement member and filler material are disposed within the interior stair space, and a resin sealing layer is provided between the wooden plate and the filler material to seal and protect the wood from the filler composition.

16 Claims, 9 Drawing Figures

STAIR CONSTRUCTION AND METHOD FOR MAKING SAME

This invention pertains to a stair or stairway step comprising a non-removable wooden shell which essentially forms the surface of the step. In the interior space of the step a reinforcement is disposed. A filler composition is poured into the space between the reinforcement and the wooden shell to connect the wooden shell and the reinforcement.

As used throughout the specification and claims, the word "stair" is used to denote either a single step or series of steps which may or may not be used in a stairway. This term is also intended to cover riser members as reffered to herein which may be used to connect individual steps.

Other stairway steps are known from West German Utility Pat. No. 7,523,309. The non-removable shell in this case may consist of thin-walled natural stone, synthetic stone, ceramic, wood or the like. The individual parts of the shell are joined flush. The reinforcement is provided in the form of rods, strips or mats, preferably fiberglass mats. The filler used is a fast-hardening, non-shrinking plastic-bonded concrete, and not ordinary concrete, which would harden with simultaneous use of cement. The plastic-bonded concrete contains no water, so that its processing, especially with a non-removable wood shell, presents no problems. This plastic-bonded concrete, however, has the disadvantage of relatively high cost. Further, the non-removable shell can be provided on its interior surface with an adhesive to form a binder with the supporting load-bearing element. However, this adhesive is not required in most cases.

The invention is based on the task of presenting a stairway step or stair with a wooden shell, in which the use of relatively expensive plastic-bonded concrete may be dispensed with and which at the same time, is nevertheless at least the equal of known stairway steps or stairs in regard to external appearance as well as strength properties. In this manner, the possibility of using steel-reinforced concrete is also provided. In addition, a process is to be demonstrated by which such steps, coverings and the like can be easily produced.

In accordance with the present invention the above objects are achieved in the case of the stairway step of the type initially described, in that between the surface of the wooden shell delimiting the interior space and the filling composition, a synthetic resin sealing layer is provided. This resin sealing layer connects the beveled wooden plates and reinforces them in the area of the bevels. Further, said sealing layer provides attachment bridges between the concrete and the wooden shell and seals the non-removable wooden shell along the interior surface thereof, so that water contained within the concrete filler is not able to attack or damage the wooden shell. At the same time, the synthetic resin layer constitutes a connecting layer, specifically in the area of the bevel miter joint. The bevel surfaces are joined together and made firmer by the synthetic resin, so that particularly strong edges form on the step. In order to achieve good adhesion between the wood and the concrete it is necessary to provide attachment bridges in some form.

In order to construct open steps, the wooden shell is composed of at least four or five individual plates. Open steps are used, for example, when a stairway is to be constructed in which the individual steps are supported on a landing construction. Stairways of this type are used especially when access is to be provided to a higher residential room or floor. To form the wooden shell, a box is made from individual plates as usual. The plates are stabilized with synthetic resin, but at first a filling opening for the concrete is left exposed depending on whether the side faces of the steps are also freely visible or not. Later, in the case of steps visible on all sides, the filling opening for the concrete is also closed with a piece or plate of wood.

In accordance with the invention, it is also possible to produce treadboards, angular steps etc. In this case, the wooden shell is made up of at least two plates. Treadboards, angular steps and the like are used especially in the case of stairs leading downward, i.e., cellar stairs or the like, wherein the steps are placed on an unfinished stairway with mortar. In this case, the wooden surface also provides the appearance of a wooden stairway, which has never before been possible in this form. Covering plates, risers and the like can even be produced. In such cases, the wooden shell consists of only a single plate, which obviously in such cases is not beveled.

In all cases, the wooden shell comprises exterior plywood. The veneer is preferably thick in order to permit subsequent processing of the outer surface if necessary. The processing of massive wood is not necessary, but the possibility of using parquet wood also exists. All this has the advantage that the wooden shell itself can be made of wood which is highly dimensionally stable, for example using chipboard, so that no external damage can be expected even upon exposure to moisture or heat.

The resin sealing layer can preferably be made of polyester, acrylic or epoxy resin. It is essential to use a synthetic resin which is impermeable to water, so that the non-removable wooden shell is effectively protected against attack by the water existing in the concrete filler.

Attachment bridges for the individual plates may be provided for better anchoring with the concrete. These may be designed as recesses located on the interior of the plates themselves. In this respect, dovetail-like grooves are preferred. These measures may be used alone. However, it is also possible for additional holders to be inserted into the dovetail shaped grooves, to anchor in the concrete after it is poured. The holders can be composed of injected plastic pieces. Another possibility which may be used consists of the fact that attachment bridges between the concrete and the wooden shell can be made of gravel, pebbles or the like joined to the synthetic resin sealing layer. The pebbles, gravel or the like represent relatively coarse material, and are within approximately the order of magnitude of 1 to 10 mm. This material is scattered onto the synthetic resin. A sanding process is also conceivable. As soon as the synthetic resin layer has set, and thus the gravel, pebbles or the like are firmly anchored, the concrete filler, made of light concrete if desired, can be poured in, so that the pebbles, gravel pieces or the like are partially surrounded by the concrete to thus form attachment bridges. At the same time, the use of these pebbles, pieces of gravel or the like, increases the surface area in contact with the concrete.

Stairs, stairway steps, angle steps, covering plates and the like of this type can be produced in various ways. One particularly advantageous production method is characterized by the fact that the plates forming the wooden shell are beveled and are united in the area of the bevel joint by an adhesive strip and are simultaneously sealed by this strip. The bevel surfaces and the surfaces of the wooden shell lining the interior chamber are then provided with a resin sealing layer. The attachment bridges are formed between the plates of the wooden shell and the filler, which comprises cement-bonded concrete. One essential point is that the plates be beveled at locations where two plates abut along an edge of the step. The area of the bevel joint is then simply connected by an adhesive strip and simultaneously sealed. This is preferably done when possible in the separated state, i.e., where the individual plates are placed in the desired arrangement side by side on a flat surface and are joined together with an adhesive strip. When three plates meet in the area of a corner of a step, one of these edges must be attached and sealed with the adhesive strip at a later point in the manufacturing process. The tapered surfaces and the surface of the wooden shell delimiting the interior area are advantageously provided with the synthetic resin, which has been, for example, sprayed or brushed thereon. Then, the wooden shell can be erected and the plastic allowed to harden, following the correct angular positioning of the individual plates. Next, the reinforcement is introduced and the interior chamber of the wooden shell, possibly with the aid of an auxiliary shell, is filled with cement-bonded concrete and permitted to harden. It is particularly to be noted that the beveled joints are connected and reinforced by synthetic resin in the area of the beveled joints, so that a perfect edge is thus formed. The edges may then even be rounded without harmful effects.

The beveled angle of the individual wooden plates can be adjusted to an angle larger than 45°, preferably 46.5°, in order that the plates can be precisely positioned in the area of the step edges, while the gap between the beveled surfaces, which is filled with synthetic resin, becomes somewhat larger toward the interior. The individual plates of the wooden shell are joined on what is later to be the outside of the step at a slight distance apart by way of the adhesive strip, so that the gap between the beveled surfaces can extend to the outside. The correct angular alignment between the plates is also achieved by this process. To form open steps, at least four plates are joined together, while for the formation of stairway steps, angle steps or the like, at least two plates are joined together. If simple covering material or risers or the like are being produced, beveling of the plates may be eliminated. Otherwise, however, the process steps enumerated hereinabove remain the same.

The invention will be further described in the following description of a preferred embodiment in conjunction with the appended drawings.

DESCRIPTION OF PREFERRED EMBODIMENT

Figure 1:
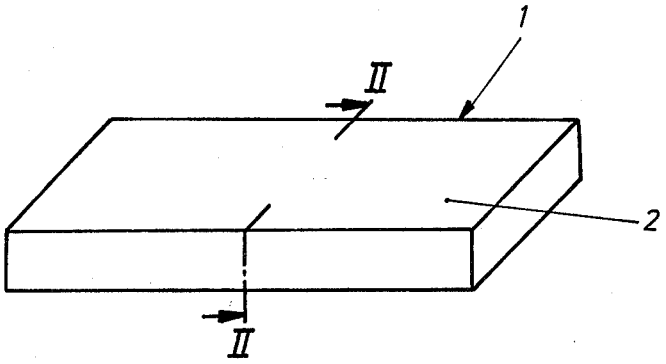
FIG. 1 is a perspective view of a step in accordance with the invention.
Figure 2:
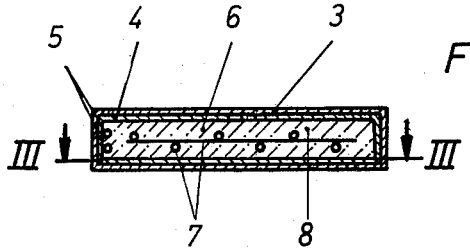
FIG. 2 is a sectional view taken along line II—II of FIG. 1.

Step 1 comprises a non-removable wooden shell 2, which forms the surface of the step and is visible from the outside. Wooden shell 2 is made from different bevel-cut plates 3 (FIG. 2). As a rule, five plates are used for producing free-standing steps. If the step 1 is to be fully closed, a sixth plate is used.

The non-removable shell 2 comprising plates 3 is provided with a resin or connecting layer 4 disposed on the inner surface of the plates 3 and the beveled edges thereof. As shown, gravel or the like 5 is embedded or anchored in resin sealing layer 4 in such manner that the major surface of the gravel 5 projects out of the layer 4. In this manner, attachment bridges are formed between the plates 3 and the concrete. The synthetic resin layer also connects the beveled surfaces of the plates 3.

in the interior chamber 6, a reinforcement 7, made for example of a steel mat, is introduced in a properly positioned, non-movable manner. The remaining space is filled with cement-bonded concrete 8, including light concrete, so that the reinforcement 7 is surrounded. The concrete also envelops the gravel, pebbles or the like 5.

Figure 3:
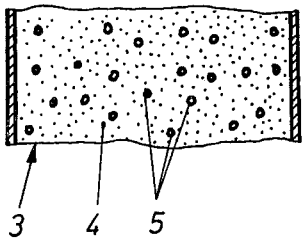
FIG. 3 is a sectional view taken along line III—III of FIG. 2.

As a result of the addition of the synthetic resin sealing layer 4, the water contained within the cement-bonded concrete cannot attack the non-removable wooden shell 2 or have a negative effect on it. FIG. 3 shows the resin sealing layer 4 which firmly anchors the pebbles, gravel or the like 5. The pebbles, gravel pieces or the like are about 1–10 mm. in diameter.

Figure 4:
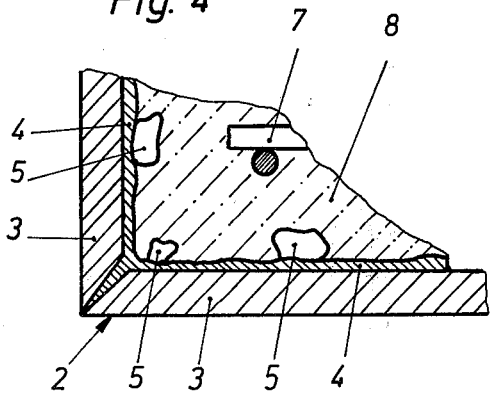
FIG. 4 is an enlarged side sectional view of a corner of the step shown in FIG. 2.

FIG. 4 shows an enlarged representation for the purpose of clearer visualization. The plates 3 of the non-removable shell 2 are beveled to an angle of 46.5°. On their inside, and in the area of the beveled surface, the resin sealing layer 4 is applied to anchor the pebbles, gravel or the like 5. These pebbles, gravel or the like 5 as well as the reinforcement 7 are closely surrounded by the concrete, so that rigid and stable attachment is achieved.

Figure 5:
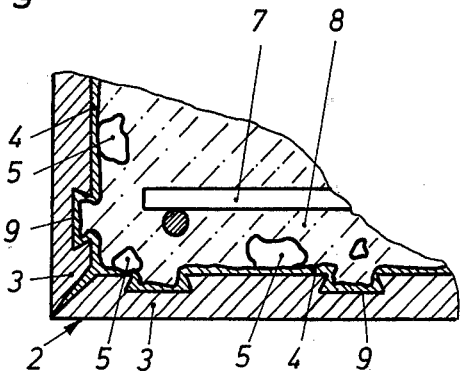
FIG. 5 is an enlarged side sectional view of a corner of another step in accordance with the invention.

FIG. 5 shows one possibility of the manner in which recesses with undercutting on the inside, may be provided on the inside portions of the plates 3. These recesses may be used in lieu of the gravel and the like 5 and provide perfect connection of the concrete to the plates 3, especially in the corner areas. Dovetail-shaped grooves 9 have proven useful as the recesses. Other forms are also conceivable.

Figure 6:
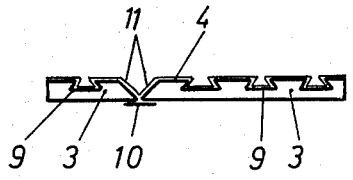
FIG. 6 is a schematic front view of two plates prior to their being joined together.
Figure 7:
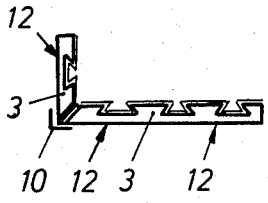
FIG. 7 is a schematic front view of the plates shown in FIG. 6 after they have been joined together.
Figure 8:
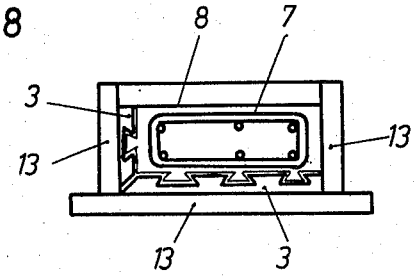
FIG. 8 is a schematic front view showing the plates in an advanced preparation stage, and FIG. 9, a side sectional view of a cellar stairway in accordance with the invention.

FIGS. 6 through 8 illustrate the production of a step, based on the example of a tread. The case involves a tread which need not have wooden front faces, which for example is to be placed between two walls on the stair frame of a cellar stairway. Thus, only two plates 3 are required. These are first beveled on their common edge, so that beveled surfaces 11 are formed. These two plates are then, with their subsequent exterior pointing upwardly, positioned with a small distance between them on a flat surface and joined with an adhesive strip 10 along the common edge. Then, the structure consisting of the two plates 3 is turned over and brought into the position shown in FIG. 6, so that the connecting and sealing layer 4 of synthetic resin may be applied. The surface of the plates 3, which is later to form the interior chamber, as well as the beveled surfaces 11 and the dovetail shaped grooves 9 are reached and covered by the synthetic resin. Then, one of the two places is set vertically upright, as shown in FIG. 7. Auxiliary and supporting means 12, which are only schematically indicated, are used to maintain a 90° angle, and the synthetic resin is then hardened. In this manner, the plates 3 are firmly joined at the proper angle. Then this wooden shell 2 is placed in an auxiliary shell 13, with the reinforcement 7 being placed therein. Casting of the concrete 8 or light concrete filler material follows. At the same time, concrete 8 forms attachment bridges in the dovetail shaped grooves 9. In addition, holders 14 can also be slid into the dovetail shaped grooves 9 before the concrete 8 is introduced, as shown in FIG. 9.

Figure 9:
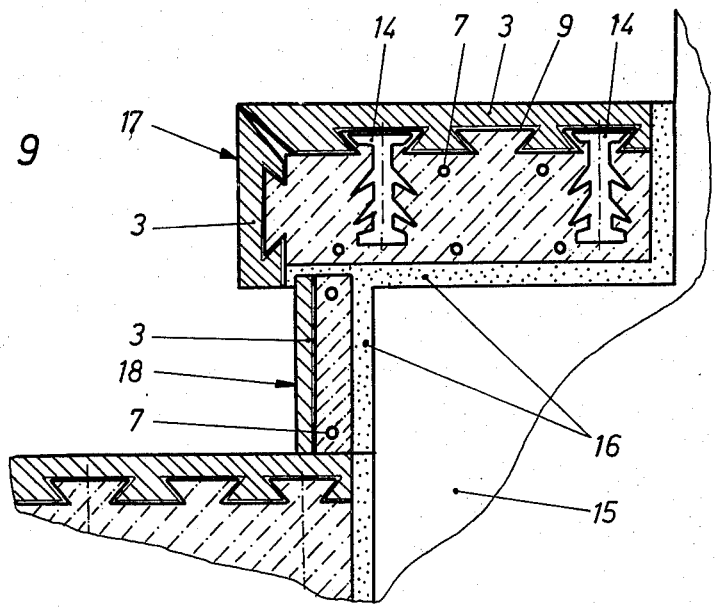

FIG. 9 shows one application of a stairway step 17 in accordance with FIGS. 6 through 8 in connection with risers 18 which comprise only a single plate 3. This plate 3 of the riser 18 need not be beveled.

I claim:

1. In a stair comprising a non-removable wooden shell which essentially forms the stair surface, a reinforcement disposed in the interior space of said stair, a hardened filling composition poured into said space and connecting said wooden shell and reinforcement, the improvement comprising:

a resin sealing layer disposed between said wooden shell and said filling composition, wherein said filling composition comprises cement-bonded concrete, said stair further comprising an attachment bridge disposed between said wooden shell and said filling composition.

2. Stair as defined in claim 1 wherein said wooden shell comprises a plurality of beveled wooden plates.

3. Stair as defined in claim 1 or 2 further comprising an opening in said wooden shell which is used as a spout for introducing said filling composition into said interior space, and a piece or plate of wood closing said opening.

4. Stair as defined in claim 1 wherein said wooden shell comprises at least two plates.

5. Stair as defined in claim 1 wherein said wooden shell comprises a single wooden plate.

6. Stair as defined in claim 1 wherein said shell comprises externally veneered plywood.

7. Stair as defined in claim 1 wherein said resin sealing layer is composed of a member selected from the group consisting of polyester, acrylic, and epoxide resins.

8. Stair as defined in claim 1 wherein said attachment bridge comprises a cut-out recess formed along the interior surface of said wooden shell, said recess being of an essentially dovetailed shape.

9. Stair as defined in claim 8 further comprising a holder member engaged in said recess.

10. Stair as defined in claim 1 wherein said attachment bridges comprise an aggregate bonded to said resin sealing layer.

11. In a process for producing a stair comprising providing a non-removable wooden shell to form the stair surface, and introducing a reinforcement and a hardenable filler composition into the interior space of said stair, the improvement comprising, providing a plurality of beveled plates to form said shell, simultaneously sealing and joining said beveled plates in the vicinity of their bevels with an adhesive strip, providing a resin sealing layer between said filler composition and said beveled plates, and forming attachment bridges between said beveled plates and said filler composition.

12. Process as defined in claim 11 comprising forming bevels having an angle of 45° or more on said plates.

13. Process as defined in claim 12 comprising forming a beveled angle of about 46.5° on said plates.

14. Process as defined in claim 11, 12, or 13 comprising laying out said beveled plates in a separated condition with a small distance existing between said plates, and then connecting said plates by means of an adhesive strip.

15. Process as defined in claim 11, 12 or 13 comprising providing four plates to form free steps.

16. Process as defined in claim 11, 12 or 13 comprising providing at least two plates.

* * * * *